United States Patent [19]

Gordon

[11] 4,114,650

[45] Sep. 19, 1978

[54] VALVE STRUCTURE

[76] Inventor: Carroll G. Gordon, 3 William Ct., Menlo Park, Calif. 94025

[21] Appl. No.: 730,225

[22] Filed: Oct. 6, 1976

[51] Int. Cl.[2] ..... F15B 13/042

[52] U.S. Cl. ..... 137/625.63; 91/52; 137/625.66

[58] Field of Search ..... 137/625.61, 625.63; 91/52

[56] References Cited

U.S. PATENT DOCUMENTS

| | | | |
|---|---|---|---|
| 2,800,143 | 7/1957 | Keller | 91/52 X |
| 3,023,781 | 3/1962 | Larsen | 91/52 X |
| 3,450,160 | 6/1969 | Tess | 137/625.64 |
| 3,474,828 | 10/1969 | Wheeler et al. | 137/625.6 |
| 3,561,489 | 2/1971 | Furrer | 137/625.63 |
| 3,583,443 | 6/1971 | Beckett et al. | 137/625.63 |

*Primary Examiner*—Gerald A. Michalsky

*Attorney, Agent, or Firm*—Edward D. O'Brian

[57] ABSTRACT

A valve structure capable of being referred to as a fluid amplifier can be constructed so as to include a principal valve and a pilot valve. Each of these valves has a valve body including a pressure port, a return port and at least one service port, and has a valve member movably mounted within the valve body so as to be capable of being moved to regulate flow between the noted ports. A first passage connects the pressure ports of the pilot and principal valves and a second passage connects the service port in the pilot valve with an actuation structure in the principal valve. This actuation structure is used to move the valve member in the principal valve in accordance with the operation of the pilot valve. A control actuator is used to move the valve member in the pilot valve. Such a control actuator is preferably a pneumatic actuator.

4 Claims, 6 Drawing Figures

VALVE STRUCTURE

BACKGROUND OF THE INVENTION

The invention set forth in this specification relates to valve structures which are responsive to an applied force in order to regulate or control hydraulic flow in response to the force. In a sense the valve structures of the invention can be considered as or referred to as fluid or hydraulic amplifiers which are intended to provide servo-type proportional control in accordance with an input force.

It is considered that the nature or character of valve structures in accordance with this invention can be best described by considering a presently intended utilization of these structures. It is considered that they are of primary utility in connection with the operation of controls such as are commonly found in oil refineries. In the past it has been conventional to utilize appropriate electrical controls in connection with refinery operation. It is considered that the use of such electrical controls in refineries is relatively undesirable because of the possibility of such controls causing the explosion of gases which are normally present in and around an oil refinery.

The recognition of the undesirability of using electrical controls in connection with oil refineries has led to the utilization of pneumatic control systems in which air pressure is utilized in connection with conventional valves. While this has been desirable in minimizing the explosion hazards this use of pneumatic control systems has been somewhat undesirable because the valves which have normally been used with such systems have been incapable of being proportionally controlled to comparatively exact control requirements. As a result of this it has been considered that a need existed for new and improved valve structures for use with such pneumatic control systems.

BRIEF SUMMARY OF THE INVENTION

A somewhat specific objective of the present invention is to provide valve structures which can be utilized in connection with such pneumatic systems so as to provide proportional flow control as desired in accordance with a pneumatic control signal. It is not to be assumed from this that the valve structures of the invention only have utility in connection with various refinery type operations. It is also considered that the valve structures of the invention can be employed in a wide variety of diverse applications. The valves of the present invention can be built so as to be controlled by a number of different types of signals.

A broad objective of the present invention is to provide new and improved valve structures. Another object of the invention is to provide valve structures which will accomplish what may be referred to as "smooth" servo-type proportional control in response to a control signal. Further objects of the invention are to provide valve structures as described which can be manufactured without significant or unusual difficulty, which are relatively inexpensive in view of their performance characteristics, and which are capable of performing satisfactorily over prolonged periods with a minimum of maintenance.

In accordance with this invention these various objectives are achieved by providing a valve structure which comprises: a principal valve and a pilot valve, the principal valve having a valve body including a pressure port, a return port and a service port and having a valve member movably mounted within the valve body so as to be capable of being moved to regulate flow between the ports in the principal valve, the pilot valve having a valve body including a pressure port, a return port and a service port and having a valve member movably mounted within the valve body so as to be capable of being moved to regulate flow between the ports and the pilot valve, a first passage connecting the pressure ports of the pilot and principal valves, the principal valve also including actuation means for moving the valve member in the principal valve in response to applied pressure, a second passage connecting the service port in the pilot valve with the actuation means, and control means for moving the valve member in the pilot valve.

With this type of structure a signal such as, for example, a pneumatic signal may be applied to the control means so as to move the valve member in the pilot valve so as to regulate flow from the pressure port of the principal valve to the pressure port of the pilot valve and thence to the service port of this pilot valve. The pressure of the fluid in the latter service port is transmitted through the second passage to the actuation means. The fluid pressure applied to the actuation means causes movement of the valve member in the principal valve so as to in turn connect the pressure port of the principal valve to the supply port of the principal valve so as to permit flow out of the supply port to an auxiliary apparatus such as, for example, a hydraulic cylinder. With the described structure the flow through the supply port of the principal valve will be proportional to the signal applied to the control means if the valve structure is constructed as hereinafter indicated.

BRIEF DESCRIPTION OF THE DRAWING

A valve structure of the invention is preferably more complex and involved than indicated in the preceding summary. For this reason the invention is best more fully explained with reference to the accompanying drawings in which.

Figure 1:
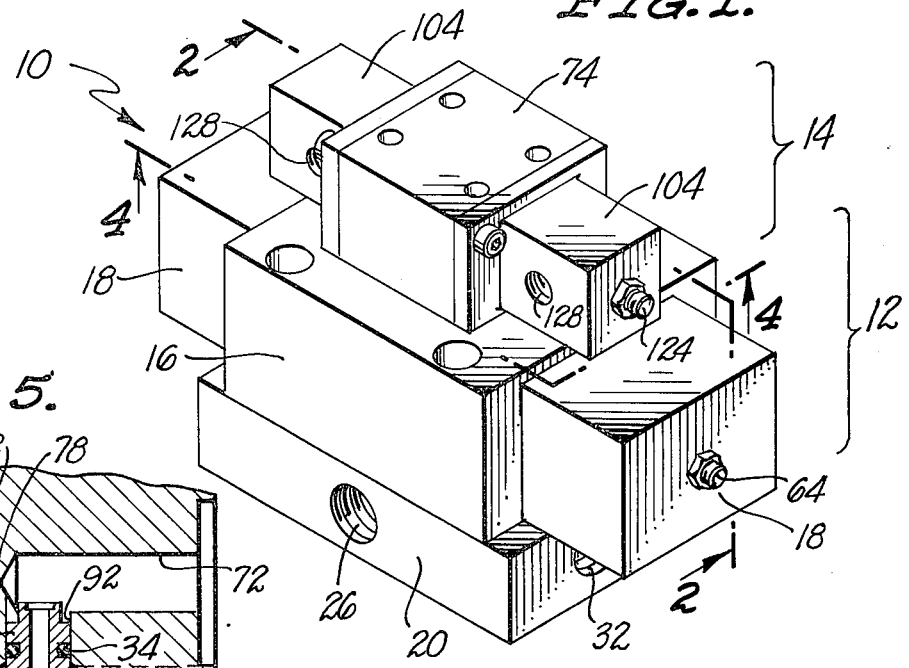
FIG. 1 is an isometric view of a presently preferred valve structure in accordance with this invention.
Figure 5:
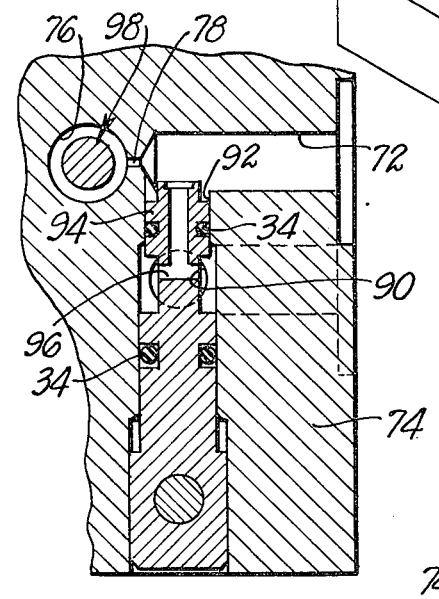
FIG. 5 is an enlarged partial cross-sectional view taken at line 5—5 of FIG. 4.
Figure 4:
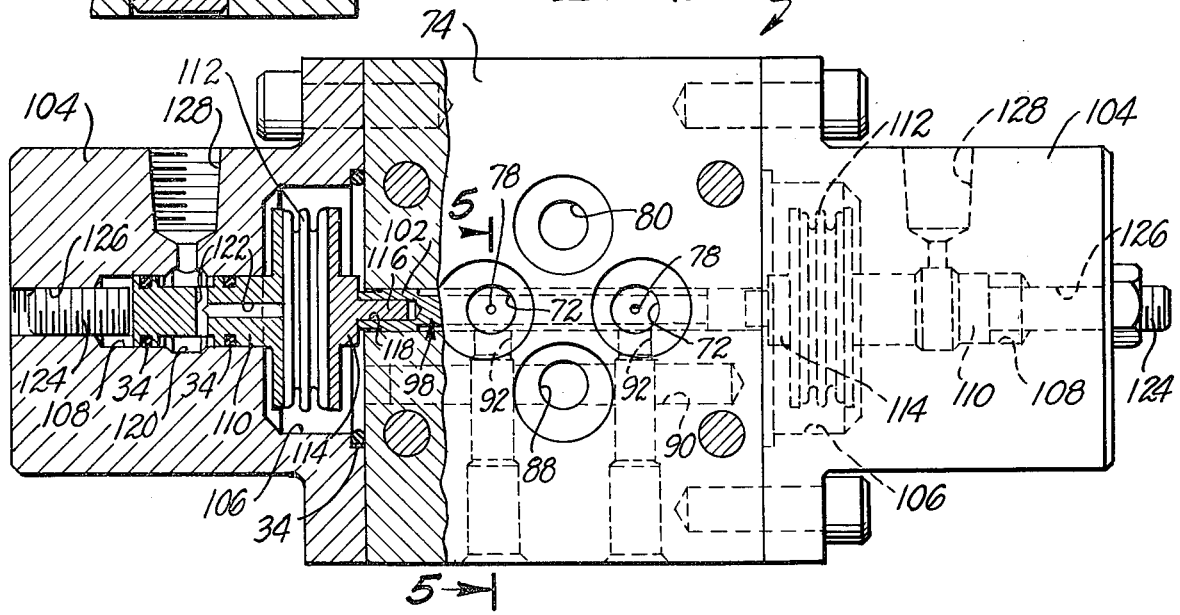
FIG. 4 is a view at an enlarged scale partially in section and partially in elevation taken at line 4—4 of FIG. 1 showing various details of the pilot valve employed in the valve structure illustrated.

It is to be understood that the valve structure shown in the drawings is but one embodiment or form of a valve structure embodying the operative principles or concepts verbally set forth and defined in the appended claims. Those familiar with the construction and design of hydraulic and pneumatic valves will realize that these principles or concepts may be utilized in many differently appearing and somewhat differently constructed valves through the use of routine engineering skill.

DETAILED DESCRIPTION

Figure 2:
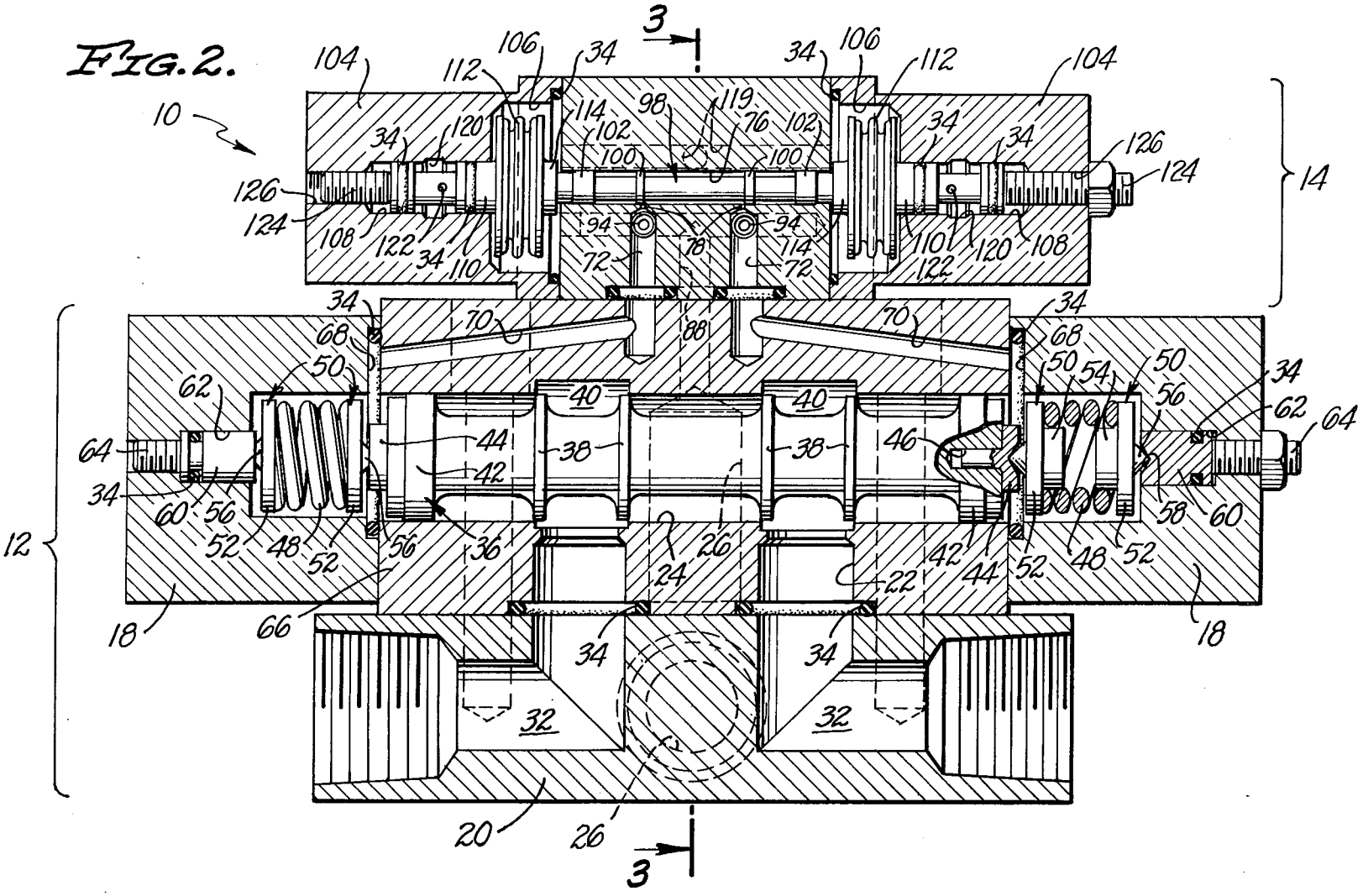
FIG. 2 is a cross-sectional view at an enlarged scale taken at line 2—2 of FIG. 1.
Figure 3:
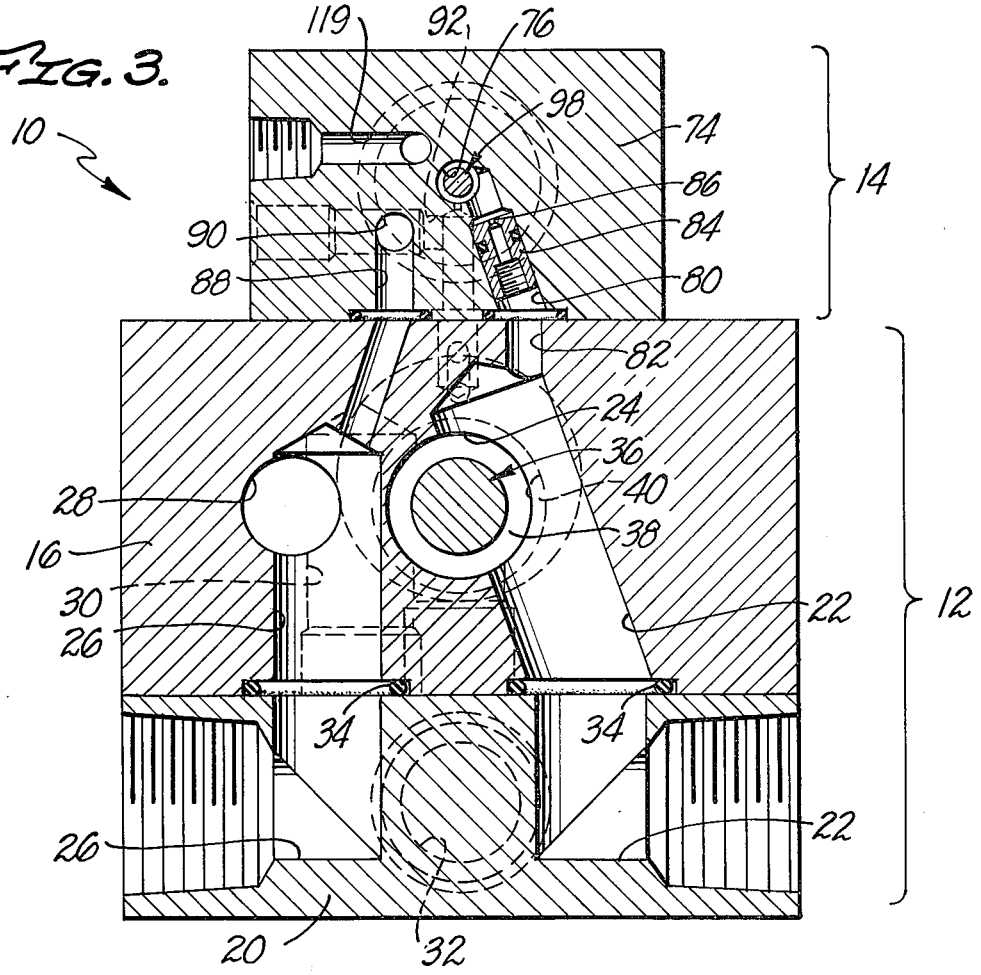
FIG. 3 is a cross-sectional view taken at line 3—3 of FIG. 2.

In the drawings there is shown a valve structure 10 of the invention which includes a principal valve 12 and a pilot valve 14. Because of the manner in which the valve structure 10 is constructed these valves 12 and 14 in effect are areas or regions within the complete valve structure 10. Hence, the principal valve 12 and the pilot valve 14 are indicated in FIGS. 1, 2, and 3 of the drawings by brackets essentially indicating the portions of the complete valve structure 10 which may be regarded as the principal valve 12 and the pilot valve 14.

The principal valve 12 includes a central body 16, end caps 18 and a bottom manifold or body 20. The bodies 16 and 20 and the caps 18 are connected together in conventional manners so as to constitute a single valve body (not separately numbered) which is formed so as to include a pressure port 22. This port 22 leads into and through the body 20 into the center of an elongated bore or cylinder 24 extending through the body 22 and into the end caps 18. The body 20 also includes a return port 26 which leads to a cross-passage 28. This cross-passage 28 in turn is in communication with intersecting passages 30 which intersect the bore 24 equidistant from the intersection of the port 22 with the bore 24. The body 20 is also provided with two service or load ports 32, each of which extends so as to intersect the bore 24 midway between the pressure port 22 and a passage 30. Appropriate conventional seals 34 are provided to prevent leakage between the bodies 16 and 20 and the end caps 18.

Within the bore 24 there is located an elongated valve member or spool 36 having circumferential flanges or lands 38 which fit closely against the interior of the bore 24 and which are spaced so as to close off the load ports 32 when the spool 36 is in a central location as indicated in the drawings. Preferably enlargements 40 are provided within the bore 24 in communication with the load ports 32 for the purpose of facilitating flow around the flanges 38 during the use of the valve structure 10. The spool 36 is also provided with ends 42 serving as pistons which fit closely against the interior of the bore 24. Small centering retainers 44 appearing much as common golf tees are inserted within holes 46 in the ends 42.

Coil springs 48 are located within the portions (not separately numbered) of the bore 24 generally within the end caps 18. The ends (not separately numbered) of these springs 48 carry centering members 50. Each of these centering members includes a disk 52 resting against an end (not separately numbered) of a spring 48, a boss 54 fitting closely within the spring 48, and a conical projection 56. Each of the retainers 44 is engaged by one of the projections 56. Other projections 56 are engaged within conical cavities 58 in movable centering retainers 60. These latter retainers 60 are movably mounted within cylindrical extensions 62 of the bore 24. Conventional seals 34 are used in connection with these extensions 62. The positions of these retainers 60 may be adjusted through the use of conventional threaded fasteners 64 mounted in threaded openings 66 in the end caps 18.

Other conventional seals 34 are located in order to prevent leakage between the end caps 18 and the body 16. Enlarged passages 68 are provided generally between the end caps 18 and the body 16 and are connected through other passages 70 with supply ports 72 in the body 74 of the pilot valve 14. An elongated bore or cylinder 76 is located in this body 74 and is in communication with service or supply ports 72 through spaced orifices 78. The body 74 also includes a pressure port 80 which is in communication with a first passage 82 extending through the body 16 so as to intersect the pressure port 22. A small fitting 84 provided with an internal pressure reducing orifice 86 is located within this pressure port 80 so that the pressure in the pressure port 80 will be less than the pressure of the fluid within the pressure port 22. This pressure port 80 intersects the bore 76 midway between the orifices 78.

The body 74 also includes a return port 88 leading to the exterior of the body 74. This return port 88 includes a cross-passage 90 connected to each of the service ports 72 by means of a connecting passage 92. The connecting passages 92 are closed off by fittings 94 shaped so as to include identically shaped pressure reducing orifices 96 serving to place the supply ports 72 in communication with the return port 88. This return port 88 is adapted to be directly connected with a fluid reservoir (not shown) when the valve structure 10 is used with a hydraulic fluid or may be vented to the atmosphere when used with a pneumatic fluid.

Within the bore 76 there is located a control spool 98 having flanges or lands 100 fitting closely within the interior of the bore 76. These flanges or lands 100 are spaced from one another so that in a central or null position of the spool 98 the orifices 78 are both partially covered to an equal extent. This spool 98 also includes enlarged cylindrical ends 102 acting as pistons so as to retain pressure within the bore 76.

End caps 104 are mounted upon the body 74 in such a manner that enlarged cylindrical cavities 106 in these end caps are aligned with the bore 76. These cavities 106 are also aligned with cylindrical openings 108 extending from the cavities 106 into the caps 104. Cylindrical bodies 110 carry identical bellows 112 located within the cavities 106. These bellows 112 are provided with bosses 114 which are adapted to bear against the ends of the spool 98 in such a manner that the spool 98 may be moved as the bellows 112 are actuated. Preferably small locating pins 116 are located upon the bosses 114 so as to extend into correspondingly shaped holes 118 in the spool 98 in order to insure proper alignment of the bellows 112 with respect to the spool 98 and to reduce "side" loading on the spool 98. Conventional seals 34 are provided around the cavities 106 between the end caps 104 and the body 74. These cavities 106 are, however, vented through vents 119.

Such seals 34 are also provided around the bodies 110 on opposite sides of peripheral grooves 120 in these bodies 110. Passages 122 are provided in the bodies 110 in order to place these grooves 120 in communication with the interiors of the bellows 112. Conventional threaded fasteners 124 are mounted in extensions 126 of the cavities 106 for the purpose of adjusting the positions of the bellows 112 relative to the end caps 106 and the body 74. Conventional threaded ports 128 in these end caps 104 lead to the grooves 120 so that appropriate pneumatic or hydraulic signals can be applied to the bellows 112 as the valve structure 10 is utilized.

The manner of operation of this valve structure 10

Figure 6:
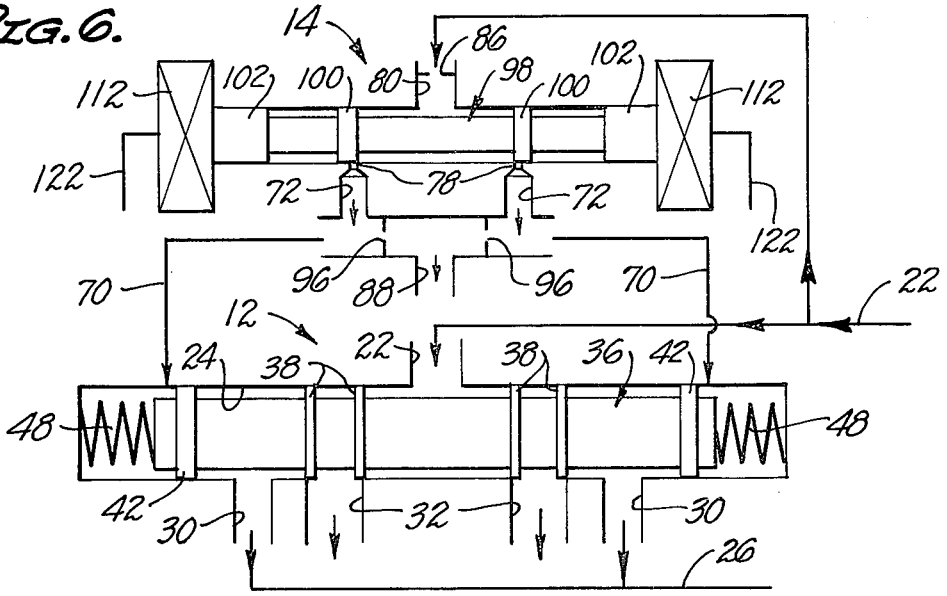
FIG. 6 is a schematic view intended to facilitate an understanding of the operation of the valve structure illustrated.

The manner of operation of this valve structure 10 is best described with reference to FIG. 6 of the drawing. As the valve structure 10 is used the ports 22, 26 and 32 are connected to various parts of a hydraulic or pneumatic system in a conventional obvious manner and the return port 88 is connected in the manner indicated in the preceding while one or both of the ports 128 are connected to pneumatic control lines. When an appropriate change in fluid pressure is supplied to the pilot valve 14 such a pneumatic signal will cause expansion or contraction of a bellows 112 used. This will in turn result in the position of the spool 98 being shifted. This will of course vary the areas of the orifices 78 exposed to the interior of the bore 76. Because the pressure port 80 is connected both to the interior of the bore 76 and to the pressure port 22 fluid under pressure will therefore be supplied to varying extents to the two supply ports 72.

As this occurs, there will be a change in the pressures exerted on the ends 42 of the spool 36 which will cause this spool 36 to shift within the bore 24 in order to connect either of the supply ports 32 with the pressure port 22 and to connect the other of the supply ports 32 with the return port 26. Concurrently the supply ports 72 will at all times be in communication with the return port 88 through the orifices 96. The "system" after it is "shifted" in the manner indicated will remain as it has been actuated or moved in response to an applied pneumatic signal until the applied pneumatic signal is changed or altered. At such time the various parts illustrated in this valve structure 10 will respond to the newly applied signal in the manner indicated in the preceding.

This manner of operation is considered to have a number of distinct advantages. It is considered that the valve structure 10 responds to any applied control signal such as a pneumatic signal as indicated in the preceding in such a manner that "smooth" servo-type control of the flow at the ports 22, 26 and 32 is obtained. Further, with a valve structure 10 constructed as described the flow at such ports 22, 26 and 32 is proportional to the applied control signal supplied pneumatically in the structure described. This is considered to be quite advantageous. The pressure applied to the ends 42 of the spool 36 are always related because of the manner of construction employed.

An important advantage of the present invention is considered to relate to the fact that a control signal is in effect employed independently within and as a part of the valve structure 10. In other words the bellows 112 and other associated structures isolate a fluid being utilized to provide the control signal used to actuate the pilot valve 14. As a result of this the possibility of contamination affecting the performance of the valve structure 10 is minimized. Various different structures can of course be employed instead of the control means herein described. Obviously a hydraulic fluid may be employed instead of a compressed gas in operating or controlling the valve structure 10 so as to regulate the utilization of a hydraulic or pneumatic fluid.

I claim:

1. A valve structure which comprises:

a principal valve and a pilot valve, said principal valve having a valve body including a pressure port, a return port, two service ports and a bore located within said body, said ports intersecting said bore, said principal valve also having a valve spool movably mounted within said bore so as to be capable of being moved to regulate flow between said ports in said principal valve, said pilot valve having a valve body including a pressure port, two service ports, and a bore within said body, said ports intersecting said bore, said pilot valve also having a valve spool movably mounted within said bore so as to be capable of being moved to regulate flow between said ports in said pilot valve, a first passage for connecting said pressure ports of said pilot valve and said principal valve with a source of fluid under pressure, said principal valve also including actuation means for moving said valve spool in said principal valve in response to applied pressure, said actuation means comprising two pistons, said pistons being located at opposite ends of said valve spool in said principal valve, second and third passages, said second passage connecting one of said service ports of said pilot valve with one of said pistons, said third passage connecting the other of said service ports of said pilot valve with the other of said pistons, said pilot valve also including two pistons, said pistons being located at opposite ends of said valve spool in said pilot valve so as to be positioned adjacent to the extremities in said bore in said pilot valve, control means for moving said valve spool in said pilot valve, said control means including two cavities in said valve body of said pilot valve and two bellows, said cavities being located at opposite extremities of said bore in said pilot valve, each of said bellows being located within one of said cavities, each of said bellows having an immovable end mounted on said body of said pilot valve and having a movable end located adjacent to said valve spool in said pilot valve, interfitting means connecting said bellows and said pilot valve spool for holding said movable ends on said bellows in alignment with said pilot valve spool, said bellows being capable of exerting pressure against said valve spool in said pilot valve so as to move said valve spool in said pilot valve in accordance with the internal pressures within said bellows, two separate port means in said valve body of said pilot valve for conveying fluid to the interiors of said bellows so as to move the free ends thereof.

2. A valve structure as claimed in claim 1 including:

pressure reducing means located in said first passage for reducing the pressure of fluid conveyed through said first passage so that the pressure of fluid conveyed to said pilot valve is less than the fluid conveyed to said principal valve.

3. A valve structure as claimed in claim 1 including:

return port means for conveying fluid from said valve structure, separate reducing means connecting said second and third passages to said return port means for conveying fluid from said second and third passages to said return port means.

4. A valve structure as claimed in claim 1 including:

pressure reducing means located in said first passage for reducing the pressure of fluid conveyed through said first passage so that the pressure of fluid conveyed to said pilot valve is less than the fluid conveyed to said principal valve, return port means for conveying fluid from said valve structure, separate reducing means connecting said second and third passages to said return port means for conveying fluid from said second and third passages to said return port means.

* * * * *